US012297841B2

(12) United States Patent
Reilly et al.

(10) Patent No.: US 12,297,841 B2
(45) Date of Patent: May 13, 2025

(54) AIR AMPLIFIER

(71) Applicant: Dyson Technology Limited, Wiltshire (GB)

(72) Inventors: Philip Tennison Reilly, Gloucester (GB); Dale Marc Comley, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 5 days.

(21) Appl. No.: 18/278,630

(22) PCT Filed: Feb. 22, 2022

(86) PCT No.: PCT/GB2022/050486

§ 371 (c)(1),
(2) Date: Aug. 24, 2023

(87) PCT Pub. No.: WO2022/180384

PCT Pub. Date: Sep. 1, 2022

(65) Prior Publication Data

US 2024/0133396 A1 Apr. 25, 2024
US 2024/0229820 A9 Jul. 11, 2024

(30) Foreign Application Priority Data

Feb. 26, 2021 (GB) ..... 2102776

(51) Int. Cl.
*F04D 29/40* (2006.01)
*F04F 5/20* (2006.01)

(52) U.S. Cl.
CPC ..... *F04D 29/403* (2013.01); *F04F 5/20* (2013.01)

(58) Field of Classification Search
CPC ..... F04D 25/08; F04D 29/403; F04F 5/16; F04F 5/46; F04F 5/20
See application file for complete search history.

(56) References Cited

U.S. PATENT DOCUMENTS 2,583,374 A 1/1952 Hoffman
3,185,067 A 5/1965 Batchelor
9,410,711 B2 * 8/2016 Wilson ..... C02F 1/325
(Continued)

FOREIGN PATENT DOCUMENTS

CN 101985949 A 3/2011
CN 201786776 U 4/2011
(Continued)

OTHER PUBLICATIONS

Examination Report received for GB Application No. 2102776.8, mailed on Jun. 20, 2023, 2 pages.
(Continued)

*Primary Examiner* — Courtney D Heinle
*Assistant Examiner* — Andrew Thanh Bui
(74) *Attorney, Agent, or Firm* — Tucker Ellis LLP

(57) ABSTRACT

An air amplifier for directing airflow from a fan assembly, and a fan assembly including an air amplifier. The air amplifier includes an inlet for receiving airflow from a fan assembly, and an airflow cavity. The airflow cavity includes a first wall and a second wall that define an airflow passageway extending towards an exhaust outlet for emitting air. A lip is provided at or towards a front edge of the first wall. The lip extends towards the second wall, thereby partially inhibiting airflow from the exhaust outlet.

15 Claims, 6 Drawing Sheets

(56) References Cited

U.S. PATENT DOCUMENTS

| | | | | |
|---|---|---|---|---|
| 9,797,612 | B2 * | 10/2017 | Staniforth | F24F 13/26 |
| 2013/0330215 | A1 | 12/2013 | Li | |
| 2014/0255173 | A1 * | 9/2014 | Poulton | F04D 25/08 415/182.1 |
| 2014/0255217 | A1 * | 9/2014 | Li | F04F 5/16 417/76 |
| 2018/0045203 | A1 | 2/2018 | Yang | |
| 2019/0170157 | A1 | 6/2019 | Mogridge et al. | |
| 2021/0270284 | A1 | 9/2021 | Jukes et al. | |

FOREIGN PATENT DOCUMENTS

| | | | |
|---|---|---|---|
| CN | 201972972 | U | 9/2011 |
| CN | 203670247 | U | 6/2014 |
| CN | 103375440 | B | 4/2016 |
| CN | 106762852 | A | 5/2017 |
| CN | 106939893 | A | 7/2017 |
| CN | 210599605 | U | 5/2020 |
| DE | 1604111 | A1 | 4/1970 |
| DE | 7217382 | U | 9/1975 |
| DE | 102011001616 | A1 | 10/2012 |
| EP | 2783116 | A2 | 10/2014 |
| EP | 2990663 | A1 | 3/2016 |
| GB | 2493672 | A | 2/2013 |
| GB | 2568939 | A | 6/2019 |
| GB | 2575066 | A | 1/2020 |
| JP | 04-366330 | A | 12/1992 |
| KR | 10-1469965 | B1 | 12/2014 |
| WO | 2013/076454 | A2 | 5/2013 |
| WO | 2022/180384 | A1 | 9/2022 |

OTHER PUBLICATIONS

International Search Report and Written Opinion received for PCT Patent Application No. PCT/GB2022/050486, mailed on Jun. 1, 2022, 10 pages.

International Search Report and Written Opinion received for PCT Patent Application No. PCT/GB2022/050492, mailed on May 2, 2022, 10 pages.

Search Report received for GB Application No. 2102776.8, mailed on Jul. 28, 2021, 1 page.

Search Report received for GB Application No. 2102777.6, mailed on Jul. 28, 2021, 1 page.

* cited by examiner

AIR AMPLIFIER

CROSS-REFERENCE TO PRIOR APPLICATION

This application is a § 371 National Stage Application of PCT International Application No. PCT/GB2022/050486 filed Feb. 22, 2022, which claims the priority of United Kingdom Application No. 2102776.8, filed Feb. 26, 2021, each of which are herein incorporated by reference in their entirety.

FIELD OF INVENTION

The present disclosure relates to an air amplifier for directing airflow from a fan assembly, and a fan assembly comprising an air amplifier.

BACKGROUND

In the field of heating and cooling systems, 'bladeless' heating and/or cooling systems are known and are becoming a popular alternative to conventional bladed fans. Known 'bladeless' systems can be used in domestic settings and may also act as air purifiers and/or humidifiers/dehumidifiers. Whilst referred to as 'bladeless', bladeless heating and/or cooling systems typically include a base that houses a fan assembly powered by a motor. An air amplifier typically sits above the base and is configured to direct air away from the fan assembly and out of an exhaust outlet. The air amplifiers typically have an annular shape with an aerofoil inner surface. As air from the fan assembly is passed out of the exhaust outlet, air is drawn through the annulus over the aerofoil surface. This enables multiplication of airflow as air passes through the air amplifier.

It is desirable to improve airflow generated by heating/cooling systems whilst achieving high energy efficiency with low noise. This requires a low pressure system.

Known air amplifiers used for bladeless heating/cooling systems have a single slot exhaust outlet, typically with a width of about 3.5 mm. Increasing the width of the exhaust outlet slot may reduce air pressure at the outlet. However, this may adversely affect air flow rate of air emitted from the exhaust slot, reducing the effectiveness of the fan. Furthermore, increasing the slot width increases the risk of ingress of foreign objects into the slot and is aesthetically undesirable.

In some instances there can be a desire to direct airflow at an angle, for instance radially inwards in the case of an annular air outlet so as to concentrate the flow of air and 'focus' it at a specific location.

There is therefore a need for a low pressure air amplifier that enables improved airflow or airflow directing, high energy efficiency and/or low noise.

SUMMARY OF INVENTION

According to a first aspect, the present disclosure provides an air amplifier for directing airflow from a fan assembly. The air amplifier comprises an inlet for receiving airflow from a fan assembly. The air amplifier comprises an airflow cavity, wherein the airflow cavity comprises a first wall and a second wall that define an airflow passageway extending towards an exhaust outlet for emitting air. A lip is provided at or towards a front edge of the first wall, thereby partially inhibiting airflow from the exhaust outlet.

The air amplifier may be configured to sit above a fan assembly provided in a base of a heating or cooling system.

The air inlet may be provided at or towards the base of the fan assembly and may be configured to direct air upwards from the fan assembly into the airflow cavity. The air inlet may direct air towards the back of the airflow cavity. The airflow cavity may have a smooth, curved back wall and the first wall and second wall of the airflow cavity may extend forward from the back wall towards the front of the air amplifier and towards the exhaust outlet, forming the airflow passageway. The exhaust outlet may be provided at the front of the airflow passageway. The exhaust outlet may comprise a slot, and the front edges of the walls of the airflow passageway may define the slot.

The air amplifier may have a ring shape that may be circular or a rounded oblong. The inner surface of the ring may comprise a smooth, aerofoil surface. As air is emitted from the exhaust outlet, air may be drawn in through the back of the air amplifier and pass over the aerofoil surface. This may lead to multiplication of airflow emitted from the front of the air amplifier.

The first wall of the airflow passageway may be the outermost wall, which forms part of the outer surface of the ring and the second wall may be the inner wall, which forms part of the interior surface of the ring. The lip may therefore extend towards the centre of the air amplifier, directing air towards the centre of the air amplifier. The lip 19 may change the direction of airflow in a similar way to a Gurney flap. The lip 19 may increase inward momentum of airflow towards the centre of the air amplifier. The lip also narrows the exhaust outlet, resulting in an increase in the airflow velocity of air emitted from the exhaust outlet. The lip does not extend across the entire of the width of the exhaust slot, such that air can still be emitted from the exhaust slot. The lip may be an extension of the first wall, or may be attached to the first wall.

The lip may extend in a direction that is substantially perpendicular to the first wall and/or the second wall. The lip may extend radially inwards towards the centre of the air amplifier across part of the width of the exhaust slot. A sharp corner may be created between the first wall of the airflow passageway and the lip. Advantageously, such an arrangement may lead to a greater momentum increase of airflow towards the centre of the air amplifier compared to a smooth and curved walled exhaust outlet. Generating the same increase in inward momentum using smoother, curved walls geometry would require a large radius of curvature of the walls. Using a sharply angled lip may save space in comparison. This may allow the air amplifier to have a larger air cavity and larger airflow passageways, thereby reducing air pressure loss within the system. The first wall and the second wall of the airflow passageway may lie parallel in the vicinity of the exhaust slot. The lip may extend partially across the exhaust slot at an angle that is perpendicular to both the first wall and the second wall.

The lip may extend towards the second wall at an angle of between about 60 and 120 degrees from the first wall. The lip may be angled inwards towards the rear of the air amplifier, whilst still partially inhibiting airflow from the exhaust outlet. Creating a sharper internal angle between the lip and the first wall of the airflow passageway may further increase the inward momentum of airflow towards the centre of the airflow cavity. Alternatively, the lip may be angled out from the front of the air amplifier.

The lip may be provided at the outermost edge of the first wall. The lip may therefore cause an increase in velocity and increase in inward momentum of airflow immediately prior to emission from the exhaust slot.

The lip may extend approximately halfway across the width of the airflow passageway. The lip may extend across less than half of the width of the airflow passageway. The lip may extend across less than ⅓ of the width of the airflow passageway. The lip may extend across at least 5% of the airflow passageway. The lip may extend across at least 10% of the airflow passageway. The lip may extend across at least 15% of the airflow passageway. The lip may extend across at least 20% of the airflow passageway. Providing a lip that extends across a small portion of the width of the airflow passageway enables increased inward momentum of air towards the centre of the air amplifier, and increased velocity of air emitted from the exhaust outlet without overly restricting airflow volume from the exhaust outlet.

A divider may be provided within the airflow passageway to divide the airflow passageway into a first exhaust passageway and a second exhaust passageway, wherein the lip partially inhibits airflow from the first exhaust passageway. The divider may be a rib. The divider may extend from the front of the airflow cavity towards the rear of the airflow cavity partway along the airflow passageway. The rib may be a straight rib provided centrally within the airflow passageway such that the first exhaust flow passageway and the second exhaust flow passageway have the same width. The rib may run parallel to the first wall and/or the second wall of the airflow passageway. The divider may be a divider body. The divider body may be a solid body or a hollow body. The divider body may widen towards the rear of the air cavity to partially or completely block the line of sight from the exhaust outlet to the back wall of the airflow cavity.

According to a second aspect, the present disclosure provides a fan assembly comprising an air amplifier. The air amplifier is an air amplifier including any of the features set out above. The fan assembly may be part of a heating and/or cooling system. The heating and/or cooling system may also function as an air amplifier. The fan assembly may be a fan assembly for use in a domestic setting.

It will of course be appreciated that features described in relation to one aspect of the present invention may be incorporated into other aspects of the present invention.

DESCRIPTION OF THE DRAWINGS

Embodiments of the present invention will now be described by way of example only with reference to the accompanying drawings of which:

FIG. 2(*b*) is a cross section taken along the line A-A shown in FIG. 2(*a*);

FIG. 4(*b*) is a cross section taken along the line A-A shown in FIG. 4(*a*), showing an angled lip and a teardrop-shaped divider body provided within the passageway;

DETAILED DESCRIPTION

Figure 1:
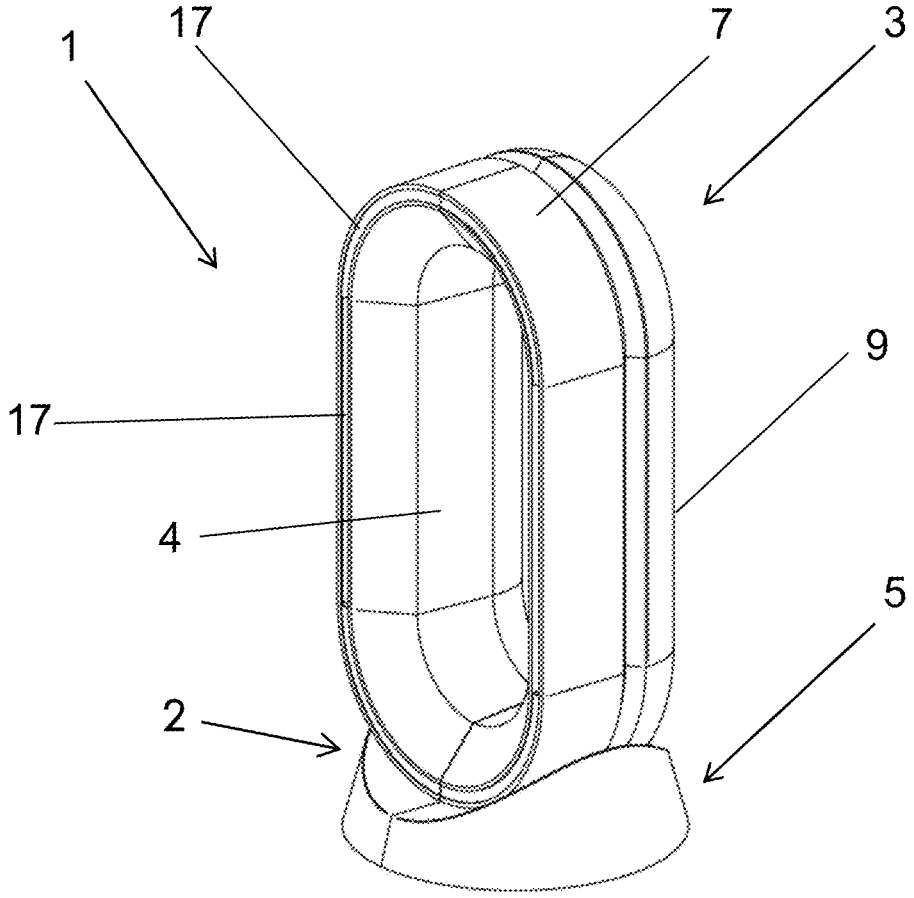
FIG. 1 is a perspective view of a fan assembly comprising an air amplifier according to a first embodiment of the present disclosure.

FIG. 1 shows a perspective view of a fan assembly 1 comprising an air amplifier 3 that sits above a base, 5 according to a first embodiment of the present disclosure. The air amplifier 3 has a rounded oblong ring shape, and the inner surface of the ring comprises a smooth, aerofoil surface 6. The base 5 houses a fan impeller (not shown) that is powered by a motor (not shown). An air inlet 2 is provided at the bottom of the air amplifier 3 and, when the fan assembly 1 is in use, the air inlet 2 receives air from the fan impeller. Air from the base 5 is directed upwards via the air inlet 2 towards the back of the airflow cavity 7.

Figure 2A:
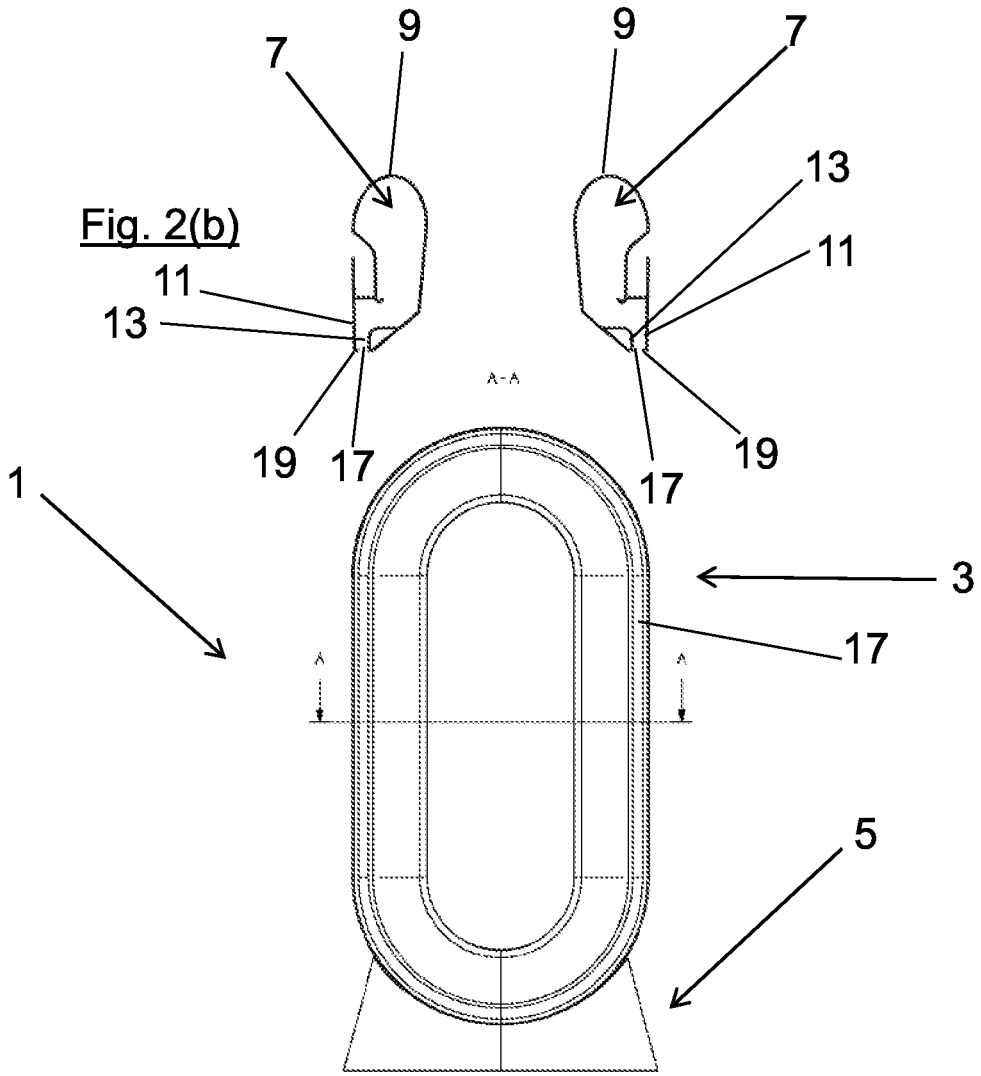
FIG. 2(*a*) is a front view of the fan assembly of FIG. 1.
Figure 3:
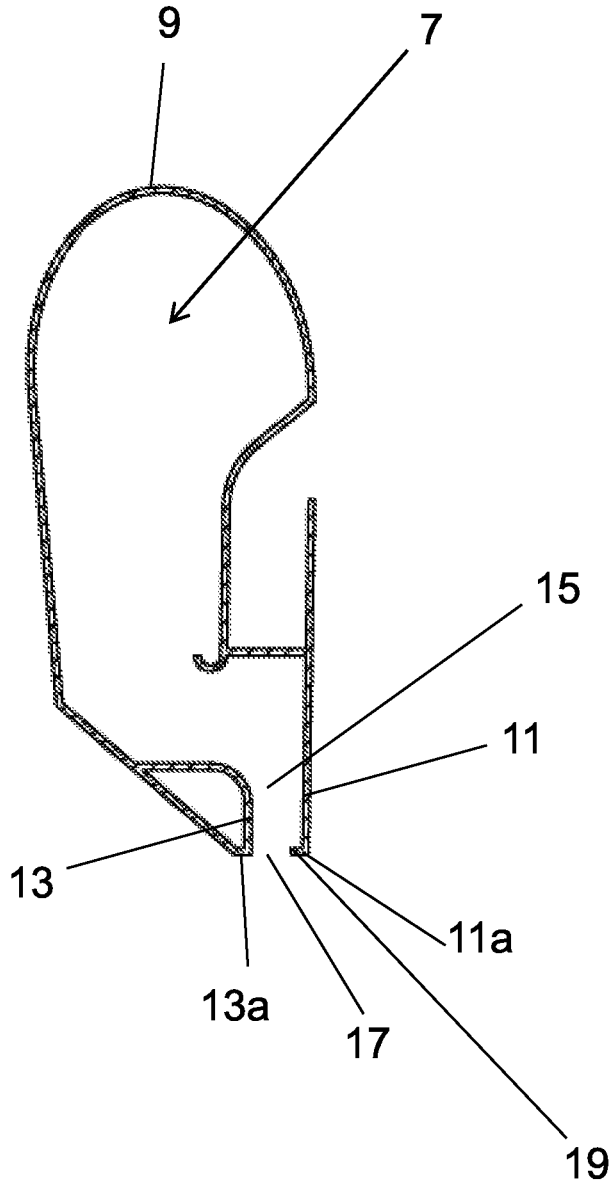
FIG. 3 is a close-up view of a portion of the cross section shown in FIG. 2(*b*)

FIG. 2(*a*) shows a front view of the fan assembly 1 shown in FIG. 1, and FIG. 2(*b*) shows a cross section taken through the air amplifier 3 along the line A-A, and FIG. 3 shows a close-up view of part of the cross-section shown in FIG. 2(*b*). The airflow cavity 7 has a smooth curved back wall 9 designed to reduce air pressure within the airflow cavity 7. A first wall 11 and second wall 13 (shown in FIG. 2(*b*) and FIG. 3) of the air amplifier extend forward towards the front of the air amplifier 3 forming an airflow passageway 15. An exhaust outlet 17 is provided at the front of the airflow passageway 15. The exhaust outlet is a slot defined by the front edges 11*a*, 13*a* of the first wall 11 and the second wall 13 (shown in FIG. 3).

In use, air flows from the back of the airflow cavity 7 forward along the airflow passageway 15 towards the exhaust outlet 17 and is emitted from the from the exhaust slot 17. As air is emitted from the exhaust slot 17, air is drawn through the back of the air amplifier 3 and passes over the aerofoil surface 4 of the ring.

A lip 19 provided at the front edge 11*a* of the first wall 11 extends towards the centre of the exhaust slot 17. The lip 19 extends perpendicularly towards the front edge 13*a* of second wall 13, spanning approximately ⅕ of the width of the exhaust slot. The lip 19 increases the inward momentum of air flowing out of the exhaust outlet 17.

The lip 19 changes the direction of airflow in a similar way to a Gurney flap. The lip 19 creates a sharp 90 degree wall angle within the airflow passageway 15, which leads to a significant increase in inward momentum in a small space compared to smooth, curved internal walls, thereby improving the performance of the air amplifier.

Figure 4A:
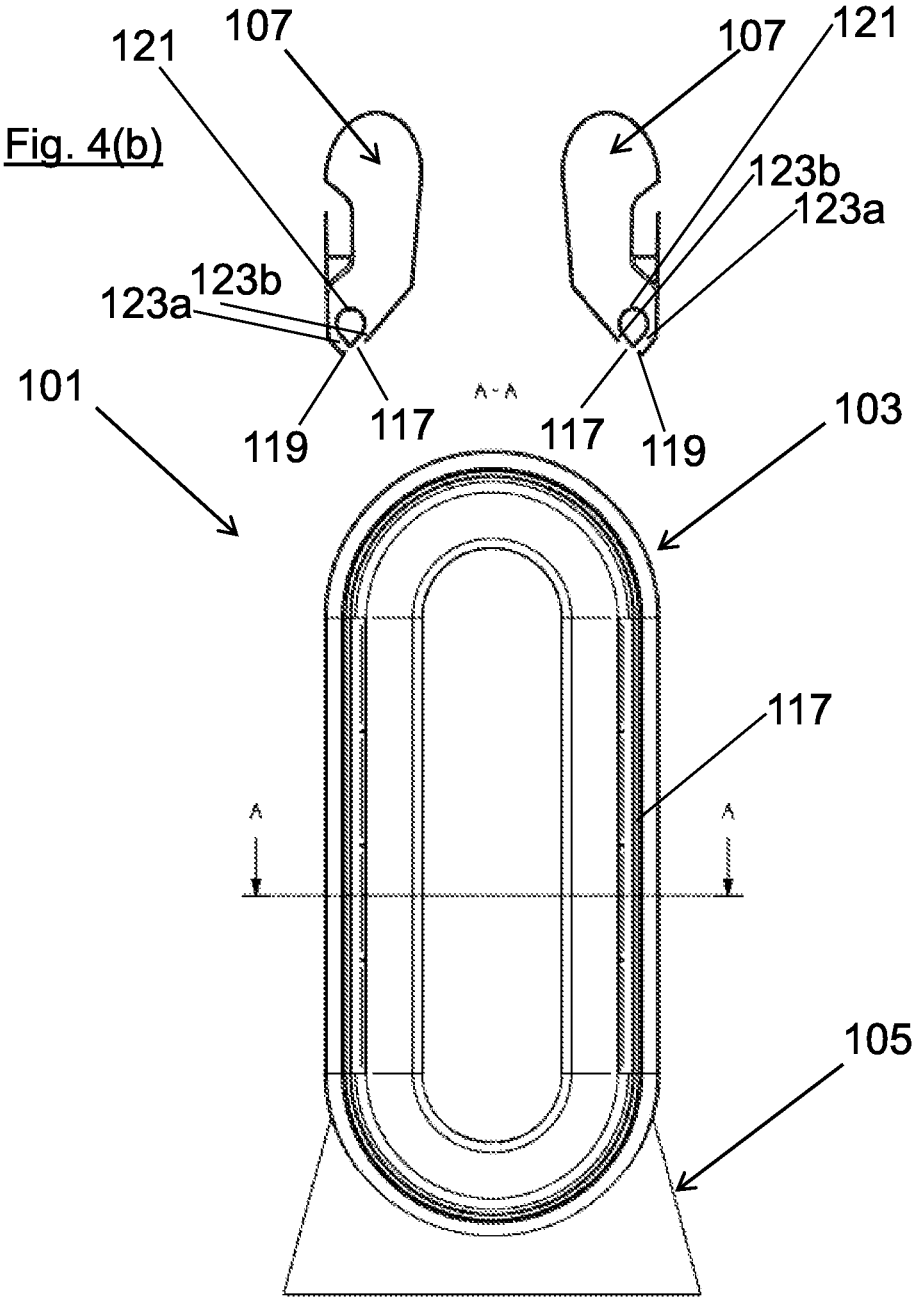
FIG. 4(*a*) is a front view of a fan assembly comprising an air amplifier according to a second embodiment of the present disclosure.
Figure 5:
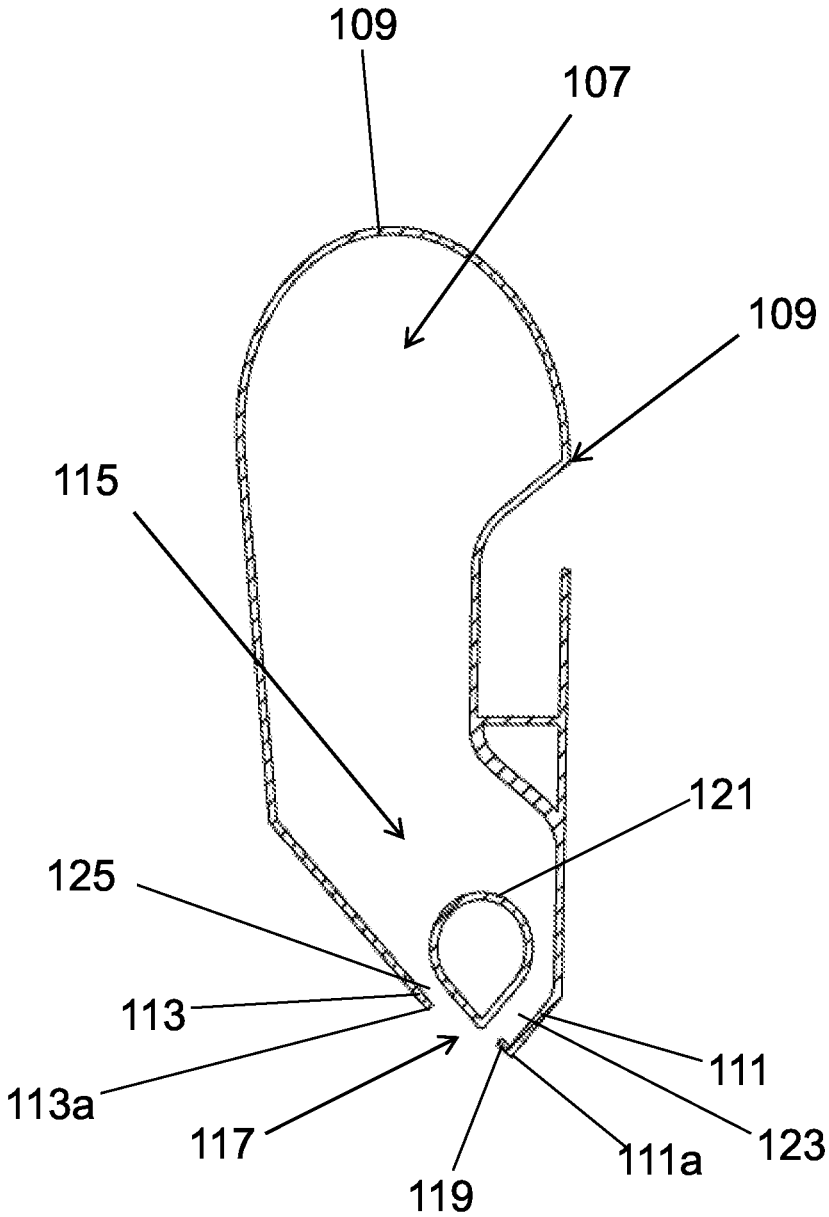
FIG. 5 is a close-up view of a portion of the cross section shown in FIG. 4(*b*)

A fan assembly 101 according to a second embodiment of the present disclosure is shown in FIGS. 4(*a*), 4(*b*) and 5. FIG. 4(*a*) is a front view of the fan assembly 101, FIG. 4(*b*) is a cross section taken through the air amplifier 103 along a line A-A, and FIG. 5 is a close-up view of part of the cross section shown in FIG. 4(*b*). Similarly to the fan assembly of FIGS. 1-3, the fan assembly 101 comprises a base 105 and an air amplifier 103 sitting on top of the base. The air amplifier 103 comprises an air cavity 107 which is substantially the same shape as the air cavity 107 shown in FIG. 3. A first wall 111 and a second wall 113 extending towards the front of the air amplifier 103 and form an airflow passageway 115, and the front edges 111*a*, 113*a* of the first wall 111 and second wall 113 define an exhaust outlet 119. A teardrop-shaped divider body 121 is provided in the airflow passageway 115. The divider body 121 divides the airflow passageway 115 into a first exhaust passageway 123 and a second exhaust passageway 125 that extend towards the exhaust slot 119. The divider body 121 tapers towards the exhaust slot 119 and widens towards the rear of the airflow passageway 115, thereby reducing the risk of foreign objects entering the exhaust slot 117 and reaching the rear of the air cavity 107, and blocking the line of sight from the exhaust slot 117 to the rear of the cavity 107. A lip 119 is provided on the front edge 111*a* of the first wall 111 and extends partially across the first exhaust passageway in a direction that is perpendicular to the first wall 111. The lip 119 extends across about 20% of the exhaust slot 117.

Figure 6:
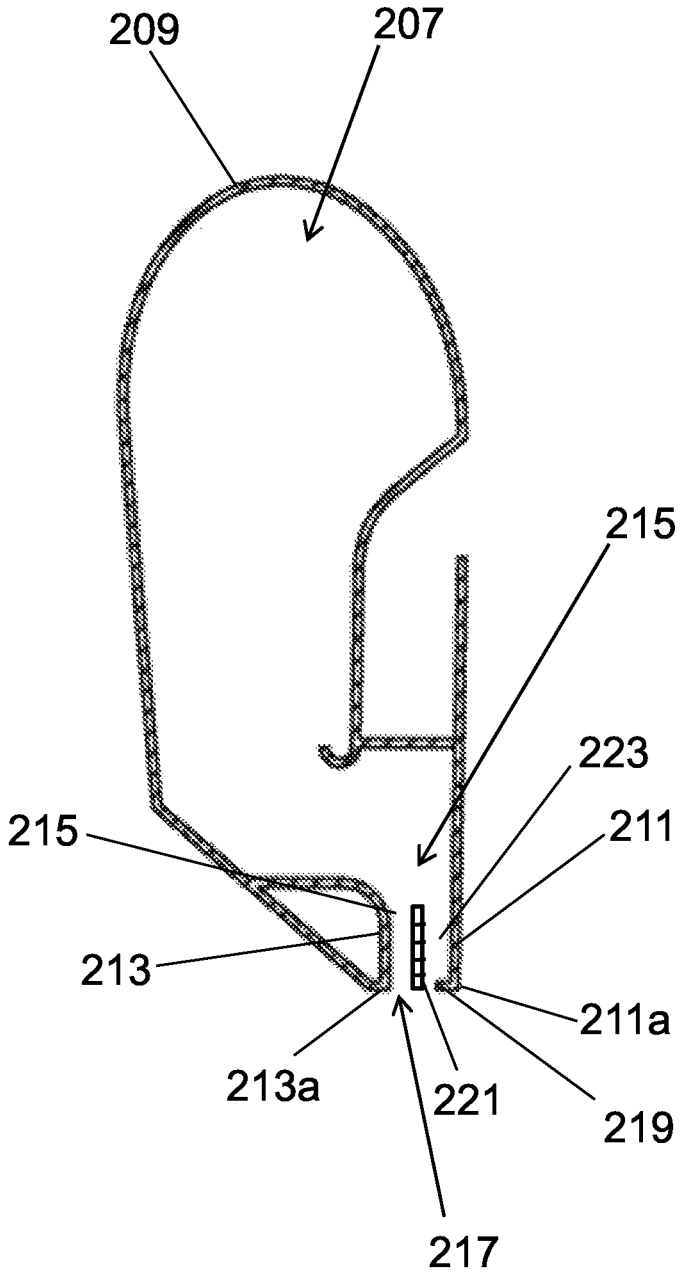
FIG. 6 is a portion of a cross section of an air amplifier according to a third embodiment of the invention showing a rib provided within the airflow passageway.

FIG. 6 shows a close-up partial cross section view through an air amplifier 203 according to a third embodiment of the invention. The airflow cavity 207 has a smooth, curved interior geometry designed to reduce air pressure within the cavity 207. A first wall 211 and second wall 213 extend towards the front air amplifier 203, and an exhaust slot 217 is defined by the front edge of the first wall 211*a* and the front edge of the second wall 213*a*. A dividing rib 221 is provided in the airflow passageway and divides the airflow passageway 215 into a first exhaust passageway 223 and a second exhaust passageway 225. A lip 219 is provided at the front edge 211*a* of the first wall 211 and extends partially across the first exhaust passageway 223 in a direction that is substantially perpendicular to the first wall 211.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

In some embodiments, the lip does not extend at a 90 degree angle from the first wall of the exhaust passageway, but extends at an angle of up to 30 degrees outwardly from the front of the exhaust slot, or inwardly by an angle of up to 30 degrees towards the rear of the air cavity.

In some embodiments, the air amplifier is part of a cooling system and/or a heating system. In some embodiments the heating and/or cooling system is also an air purifier. In some embodiments a heating element is provided at the rear of the airflow cavity and the divider body blocks the line of sight from the exhaust outlet to the heating element.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. An air amplifier for directing airflow from a fan assembly, the air amplifier comprising:

an inlet for receiving airflow from the fan assembly; and an airflow cavity, wherein the airflow cavity comprises a first wall and a second wall that define an airflow passageway extending towards an exhaust outlet for emitting air;

wherein a lip is provided at an outermost edge of the first wall, and wherein the lip is an integral extension of the first wall and extends towards the second wall at an angle that is perpendicular to the first wall, thereby forming a sharp corner between the first wall and the lip within the airflow passageway, thereby partially inhibiting airflow from the exhaust outlet.

2. The air amplifier according to claim 1, wherein the lip extends in a direction that is substantially perpendicular to the first wall and/or the second wall.

3. The air amplifier according to claim 1, wherein the lip extends towards the second wall at an angle of between about 60 and 120 degrees from the first wall.

4. The air amplifier according to claim 1, wherein the lip extends less than half of the width of the airflow passageway.

5. The air amplifier according to claim 1, wherein the lip extends across less than ⅓ of the width of the airflow passageway.

6. The air amplifier according to claim 1, wherein the lip extends across at least 5% of the width of the airflow passageway.

7. The air amplifier according to claim 1, wherein the lip extends across at least 10% of the width of the airflow passageway.

8. The air amplifier according to claim 1, wherein a divider is provided within the airflow passageway to divide the airflow passageway into a first exhaust passageway and a second exhaust passageway, wherein the lip partially inhibits airflow from the first exhaust passageway.

9. A fan assembly, the fan assembly comprising the air amplifier as claimed in claim 1.

10. The air amplifier according to claim 1, wherein the width of the airflow passageway is greater than a width of the exhaust outlet.

11. The air amplifier according to claim 1, wherein the second wall extends in a vertical direction, and the lip extends towards the second wall in a horizontal direction.

12. The air amplifier according to claim 1, wherein the first wall and the second wall extend in parallel, and wherein the lip extends substantially perpendicular to the first wall at a front edge of the first wall.

13. The air amplifier according to claim 1, wherein the first wall extends in a first direction, and wherein the first wall extends in a second direction different than the first direction to form the lip.

14. The air amplifier according to claim 13, wherein an angle between the first direction and the second direction is 90 degrees.

15. The air amplifier according to claim 13, wherein an angle between the first direction and the second direction is at most 30 degrees.

* * * * *